United States Patent [19]

Crawford

[11] Patent Number: 4,653,400

[45] Date of Patent: Mar. 31, 1987

[54] TWO COMPONENT THRU-BULKHEAD INITIATOR

[75] Inventor: John F. Crawford, Huntsville, Ala.

[73] Assignee: The United States of America as represented by the Secretary of the Army, Washington, D.C.

[21] Appl. No.: 751,701

[22] Filed: Jul. 3, 1985

[51] Int. Cl.[4] ..... F42C 19/08

[52] U.S. Cl. ..... 102/202; 102/275.7; 102/275.12

[58] Field of Search ..... 102/202, 275.4, 275.7, 102/275.12; 60/256

[56] References Cited

U.S. PATENT DOCUMENTS

| | | | |
|---|---|---|---|
| 2,561,670 | 7/1951 | Miller et al. | 102/202 |
| 2,934,014 | 4/1960 | Smith et al. | 102/202 |
| 3,209,692 | 10/1965 | Webb | 102/275.4 |
| 3,945,322 | 3/1976 | Carlson et al. | 102/275.4 |
| 3,982,488 | 9/1976 | Rakowsky et al. | 102/205 |

*Primary Examiner*—Charles T. Jordan

*Attorney, Agent, or Firm*—Freddie M. Bush; Harold W. Hilton

[57] ABSTRACT

A two piece thru-bulkhead initiator. A first member carried by a rocket motor encloses a pyrotechnic charge and a receptor charge. A second member enclosing a confined detonating fuse and a receptor charge is releasably secured to the first member. The mating surfaces between the two members must not contain air gaps.

3 Claims, 1 Drawing Figure

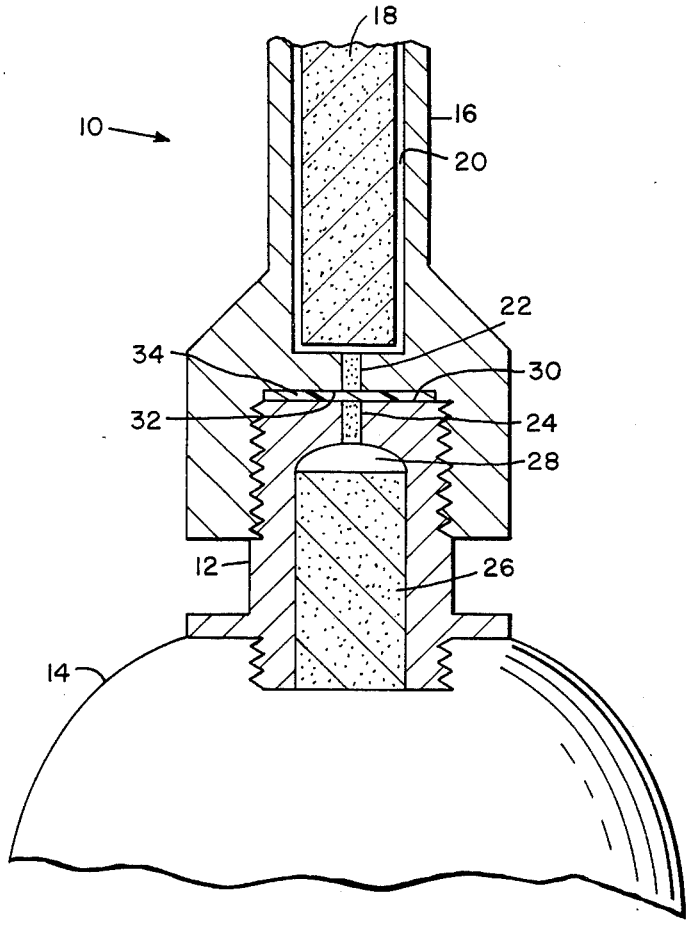
18
10
16
20
22
34
30
32
24
28
12
26
14

TWO COMPONENT THRU-BULKHEAD INITIATOR

DEDICATORY CLAUSE

The invention described herein may be manufactured, used, and licensed by or for the Government for governmental purposes without the payment to me of any royalties thereon.

BACKGROUND OF THE INVENTION

Conventional thru-bulkhead type initiators are one piece of machined steel. When such type initiators are used in rocket motors it is necessary that they be permanently retained with the motor casing and, therefore, may be accidentally ignited during shipment or storage of the missile. Applicant's device is a two piece initiator of machined steel having a metal to metal interface. The donor charge which is used to ignite the pyrotechnic charge in the motor need not be assembled until the missile is in the field.

SUMMARY OF THE INVENTION

A thru-bulkhead type initiator comprised of a first member housing a donor charge which is adapted to be releasably secured to a second member of a rocket motor having a receptor charge therein for igniting a pyrotechnic charge, also in the motor, responsive to initiation of the donor charge. The interface between the mating surfaces of the first and second members must be extremely smooth and no air gap must be present.

BRIEF DESCRIPTION OF THE DRAWINGS

The FIGURE is an elevational sectional view of the thru-bulkhead initiator of the present invention.

DESCRIPTION OF THE PREFERRED EMBODIMENT

As seen in the FIGURE the two component thru-bulkhead initiator 10 includes a nipple 12 extending from a rocket motor 14 and a second member 16 which is adapted for threaded engagement with nipple 12.

Member 16 encloses a confined detonating fuse 18 in a closure 20 and a donor charge 22 beneath fuse 18. Nipple member 12 encloses a receptor charge 24 and a pyrotechnic charge 26. A gap 28 is provided between the receptor charge 24 and pyrotechnic charge 26. The interface between the mating surfaces 30 and 32 of nipple member 12 and member 16, respectively, must be extremely smooth so as to prevent an air gap from occurring between surfaces 30 and 32. To prevent an air gap from occurring a gel coating 34 may be applied to the two surfaces prior to assembly. The coating may be in the form of a silicon grease or a thick gel. Such coating reduces the resistance to the shockwave occurring in response to initiation of the confined detonating fuse 18. The wave is more easily propagated through the coating or gel than through air.

In operation the confined detonating fuse is ignited which in turn ignites the donor charge which propagates shockwaves across the interface of surfaces 30 and 32 for initiation of the receptor charge 24 which ignites the pyrotechnic charge 26 of the rocket motor.

I claim:

1. A two piece thru-bulkhead initiator comprising:

a. a rocket motor casing having a first member protruding therefrom;

b. first detonating means carried in said first member, said first detonating means being a confined detonating fuse and a donor charge in serial relation therewith;

c. a second member disposed for releasably secured relations with said first member;

d. second detonating means carried in said second member, said second detonating means being a receptor charge and a pyrotechnic charge in serial relation therewith; and e. sealing means for sealing the interface between mating surfaces of said first and second members to prevent occurrence of air gaps therebetween.

2. A device as in claim 1 wherein said sealing means is a gel coating.

3. A device as in claim 1 wherein said sealing means is a coating of silicon grease.

* * * * *